United States Patent [19]

Pintar

[11] Patent Number: 4,970,623

[45] Date of Patent: Nov. 13, 1990

[54] PERIPHERAL DEVICE POWER ACTIVATION CIRCUIT AND METHOD THEREFOR

[75] Inventor: Robert R. Pintar, Eagle, Id.

[73] Assignee: Hewlett-Packard Company, Palo Alto, Calif.

[21] Appl. No.: 291,631

[22] Filed: Dec. 29, 1988

[51] Int. Cl.[5] ..... H01H 47/00

[52] U.S. Cl. ..... 361/187; 307/38; 361/186

[58] Field of Search ..... 307/38, 112, 125, 130; 361/160, 170, 186, 187, 93

[56] References Cited

U.S. PATENT DOCUMENTS

| | | | |
|---|---|---|---|
| 4,228,364 | 10/1980 | Walden | 307/38 |
| 4,336,462 | 6/1982 | Hedges | 307/38 |
| 4,471,232 | 9/1984 | Peddie et al. | 307/38 |
| 4,675,537 | 6/1987 | Mione | 307/38 |

*Primary Examiner*—A. D. Pellinen
*Assistant Examiner*—Jeffrey A. Gaffin

[57] ABSTRACT

A circuit and method which are operative to activate a peripheral device, such as a printer, in response to a current surge in a parent device, such as a computer or word processor. The circuit includes a detector which is operative to detect a surge in current demanded by the parent device and further comprises electronic switching circuity, including a comparator, connectec to the detector and responsive to an output signal from the detector for activating the peripheral device immediately after the occurrence of the current surge in the parent device. in this manner, the present invention allows the peripheral device to remain inoperable and quiet and consume no power until such time that it is needed and without requiring an operator to expend the time and effort to turn on a power switch for the peripheral device.

15 Claims, 3 Drawing Sheets

PERIPHERAL DEVICE POWER ACTIVATION CIRCUIT AND METHOD THEREFOR

BACKGROUND OF THE INVENTION

1. Technical Field.

This invention generally relates to electrical circuits for activating peripheral devices responsive to a parent device power up, and in particular this invention relates to an electrical circuit which only activates the peripheral device responsive to increased activity of the parent device.

2. Background Art.

There are many situations in which it is advantageous to delay activation of peripheral devices until after the parent device is powered up and has attained a quiescent state. A typical situation is that of a personal or business computer system where the activation of the monitor, disk drives, printers, etc. are delayed until after the computer itself is fully on-line.

MIONE, U.S. Pat. No. 4,675,537, teaches an outlet strip which contains an intelligent outlet from which the computer or parent device is supplied. Upon activation of the parent device, the intelligent outlet will delay activation of the outlets supplying the peripheral devices until the parent device has had time to attain a quiescent operating state. The outlet strip is especially helpful in eliminating undesirable transient currents and random logic states caused by simultaneous power up of the parent and peripheral devices.

In any given computer system, the computer and monitor generally have very similar duty cycles while a disk drive would typically have a substantially smaller duty cycle and a printer or paper stacker would demonstrate yet even a smaller duty cycle. Disk drives and printers are relatively quiet when not being addressed by the computer. A paper stacker, however, is quite loud and annoying to the computer operator in its quiescent state.

It should be readily apparent that the smart outlet power strip of Mione does not provide an adequate solution to this problem, because the paper stacker will remain on essentially the entire time the computer is on. Besides being loud and annoying, allowing the paper stacker to remain on when not in use substantially decreases its life expectancy. Heretofore, the solution to this problem has simply been for the operator to manually switch the paper stacker on and off as necessary. This is obviously a great inconvenience to the computer operator. Further, a great deal of operator time is consumed running back and forth to switch the paper stacker on and off.

What is needed is an electrical circuit for activating a peripheral device, e.g. a paper stacker, responsive to increased activity of the parent device, which is in this case, the cooperating computer printer.

It is therefore an object of the present invention to provide an electrical circuit which is capable of detecting a current surge in the power line of the parent device and activating the peripheral device in response thereto.

DISCLOSURE OF INVENTION

This and other objects are accomplished by an electrical circuit which includes an inductive current sensor for detecting current flow in a parent devices' power supply line and an electromagnetic or solid-state relay for activating the peripheral device responsive to a power line current surge.

One embodiment of the present invention has a toroidal current transformer having its outputs connected across a full-wave bridge rectifier. The induced, rectified current produced by the full-wave rectifier is converted to a voltage by a load resistor. This voltage is compared to a reference signal by a comparator circuit. The magnitude of the reference signal corresponds to a quiescent current level in the parent device power supply line. When the load resistor voltage exceeds that of the reference voltage, a current surge is detected. The output of the comparator is directed to a retriggerable monostable multivibrator which upon triggering produces an activation pulse of a selectable and known duration. The activation pulse is directed to an electromagnetic or solid-state relay which activates the peripheral device by connecting it to its power supply.

A second embodiment, which includes digital circuitry and a microcontroller, is capable of distinguishing current surges in the power line due to parent device activity, from power line fluctuations such as brownouts and the like. The second embodiment is further capable of automatically determining the quiescent current level in the power supply line of the parent device. This is significant in that the present invention is retrofittable to any parent device regardless of quiescent current or voltage demands.

Upon detection of parent device activity, the microcontroller is configured to generate an activation signal, whose duration is selectable, for instance, dependent upon the amount of parent device activity. The activation signal is directed to a solid-state relay, such as a triac. An optoisolator is provided between the microcontroller and the triac to isolate the microcontroller from the peripheral device power supply line voltage. The triac is connected between a suitable power supply and the peripheral device, for switching the peripheral device on and off.

The advantages of the present invention are numerous and include elimination of personal attention in activating peripheral devices, extended lives of peripheral devices, and reduced operating noise by only periodic activation of the peripheral devices.

BEST MODE FOR CARRYING OUT INVENTION

Figure 1:
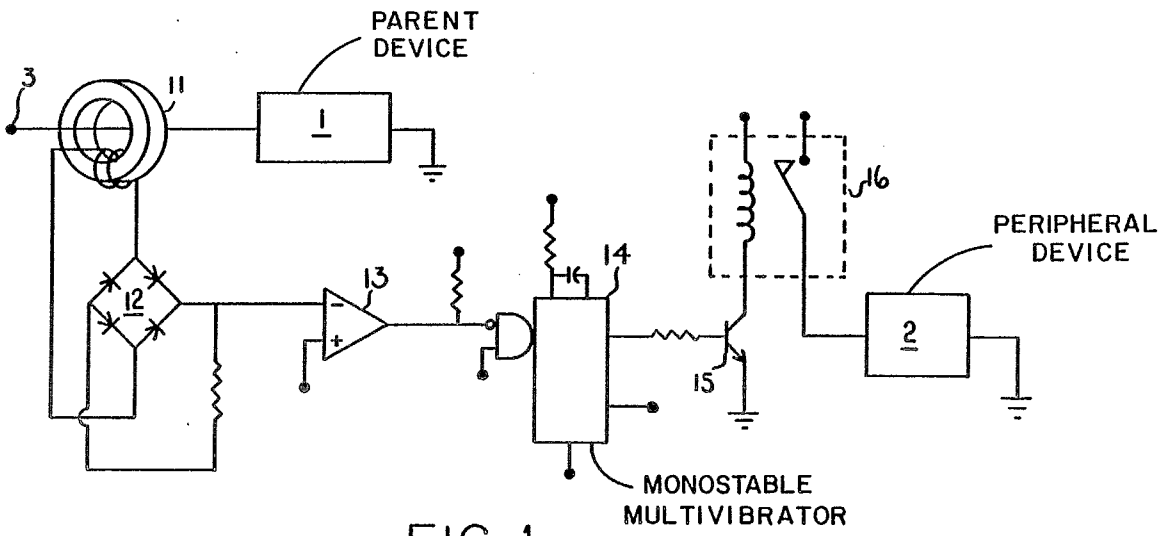
FIG. 1 is a circuit schematic of a first embodiment of the present invention.

A circuit for activating a peripheral device 2, such as a paper stacker, responsive to activity of a parent device 1, such as a cooperating printer, is shown in FIG. 1. A toroidal current transformer 11 inductively monitors the current flow in the printer power supply line 3. Current surges, due to an increase in the activity of the parent device, can be detected by monitoring the induced current in toroidal current transformer 11. A full-wave bridge rectifier 12 is connected across the output of toroidal current transformer 11 and is used to rectify the induced current. The rectified current output of full-wave bridge rectifier 12 is converted to a voltage and compared to a reference voltage by comparator 13, which is a LM339 comparator. When the rectified voltage exceeds the reference voltage, comparator 13 generates a trigger pulse which triggers a retriggerable monostable multivibrator 14, which in this embodiment is a 74123 retriggerable one-shot. Monostable multivibrator 14 provides a relay activation pulse of known duration to the base of transistor 15. Transistor 15 will then turn on and activate the coil of electromagnetic relay 16. Upon activation, electromagnetic relay 16 will activate peripheral device 2 by closing the circuit between the power supply and peripheral device 2. The peripheral device 2 may utilize the same power supply as the parent device 1 or a separate power supply.

Figure 2:
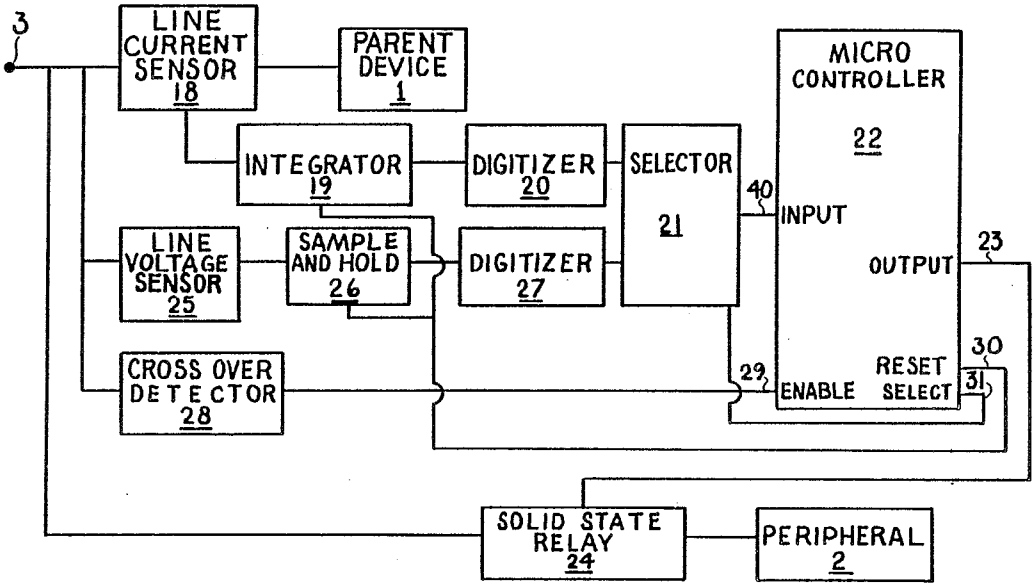
FIG. 2 is a block diagram of a second embodiment of the present invention.

A second embodiment of the present invention is shown in the block diagram of FIG. 2. The second embodiment is essentially a digital equivalent of the first embodiment which additionally provides the ability to monitor quiescent current and voltage levels in the power line to distinguish between fluctuations due to increased printer activity or due to power line level fluctuations. The second embodiment is further capable of detecting the crossover points (i.e., zero crossing points) of the peripheral device power supply line voltage. This allows the peripheral device to be activated or deactivated only when a supply voltage crossover occurs, thereby minimizing switching transients.

As can be seen in FIG. 2, line current sensor 18 is operably connected to the parent device power supply line 3. This coupling is accomplished by electromagnetic induction. The output of the line current sensor 18 is integrated by integrator 19. The output of integrator 19 is then digitized by digitizer 20. Digitizer 20 is here, simply an analog to digital converter. The output of digitizer 20 is then coupled to selector 21. Selector 21 is, in this preferred embodiment, a dual input serial multiplexer. The output of selector 21 is coupled to microcontroller 22 on line 40. Microcontroller 22 will then use the digital value of the parent device power supply line current to determine a quiescent current level and compare subsequent line current readings to detect current surges. The primary output of microcontroller 22 on line 23 is routed to a solid-state relay 24. The solid-state relay 24 is connected between the power supply line 3 and the peripheral device 2 and will complete the circuit responsive to a valid power line current surge detection.

A line voltage sensor 25 is connected to the power supply line 3 and is used to monitor the supply voltage. The output of voltage sensor 25 is directed to a sample and hold circuit 26 which latches the power supply peak voltage level. The latched value within sample and hold circuit 26 is digitized by digitizer 27, an analog to digital converter. The output of digitizer 27 is coupled to selector 21. From selector 21 the digitized voltage value is directed to microcontroller 22 on line 40. Microcontroller 22 alternately analyzes current and voltage values to determine whether a particular current surge is due to a power line fluctuation or to increased activity of parent device 1. Microcontroller 22 selects either the voltage sample or the current sample via a select signal output on line 31. A reset signal on line 30 allows microcontroller 22 to reset the integrator 19 and the sample and hold circuit 26 every half cycle of the parent device power supply voltage.

A crossover detector 28 is also connected to power supply line 3 and is used to detect the crossover points of the alternating voltage in the peripheral device power supply line 3. The crossover detector 28 provides an enable signal on line 29 to the enable input of microcontroller 22. Microcontroller 22 uses the enable signal to synchronize activation of peripheral device 2 with a crossover detection. By switching peripheral device 2 on or off only at cross-over, transients and random digital noise are minimized.

Figure 3:
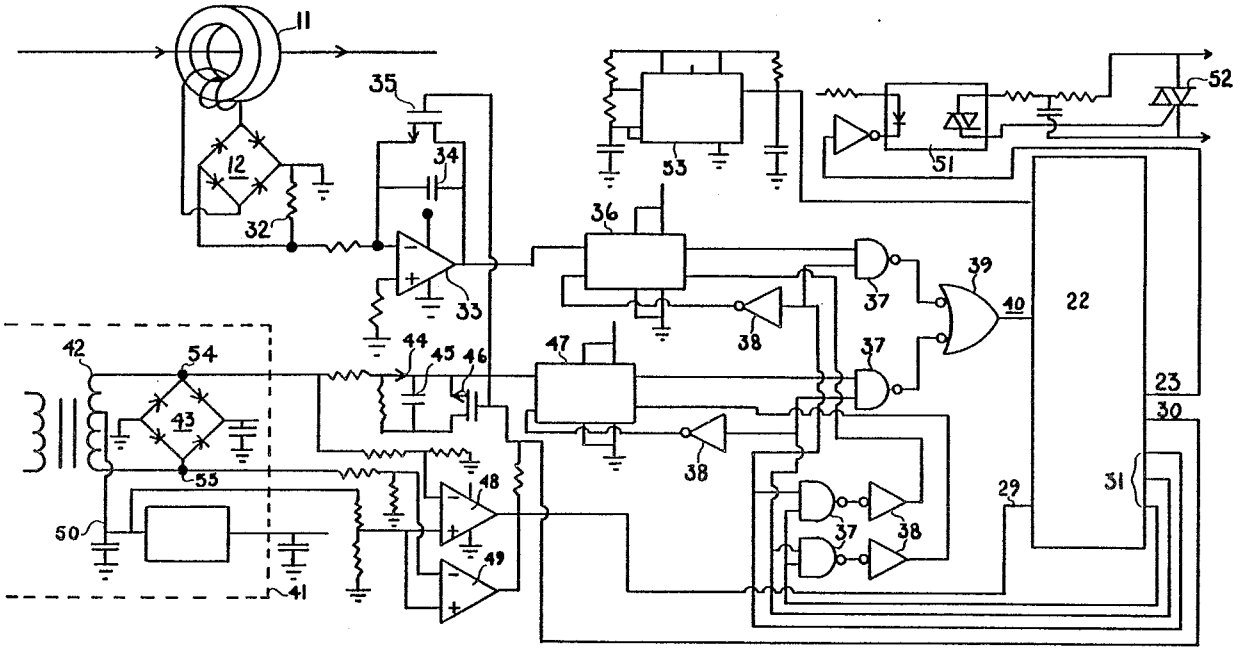
FIG. 3 is a detailed circuit schematic of the second embodiment of the present invention.

Referring also now to FIG. 3, a detailed circuit schematic of the second embodiment of the present invention is shown. The individual components of the circuit schematic of FIG. 3 will be described in detail as they relate to the circuit blocks of FIG. 2.

Line current sensor 18 is here defined by toroidal current transformer 11 coupled with full-wave bridge rectifier 12. The induced rectified current signal from the output of the full-wave bridge rectifier 12 is converted to a voltage by load resistor 32. The voltage across load resistor 32 is integrated by integrator 19, which consists of an operational amplifier 33, a LM358, and an integrating capacitor 34. Integrator 19 is reset every one-half cycle by a reset signal from microcontroller 22 by field effect transistor (FET) 35. Microcontroller 22 is in this preferred embodiment a COP 404C. The integrated signal from integrator 19 is coupled to digitizer 20 which consists of a serial output analog to digital converter 36, a TLC548. The digitized signal is then coupled to selector 21 which is a configuration of NAND gates 37, invertors 38 and OR gate 39. The output of OR gate 39 is connected to input 40 of microcontroller 22. Input 40 is a serial input.

Line voltage sensor 25 and crossover detector 28, are in this particular embodiment, operably connected across the secondary transformer coil 42 of peripheral power supply 41. Connecting line voltage sensor 25 and crossover detector 28 to peripheral power supply 41, rather than directly to parent device power supply line 3, eliminates the need to compensate for crossover point discrepancies which would occur between the primary and secondary transformer coils of peripheral power supply 41 due to phase changes. While this particular configuration of line voltage sensor 25 and peripheral power supply 41 is typical of that of a paper stacker, it should be obvious to one skilled in the art that line voltage sensor 25 and crossover detector 28 could be configured to connect to any other peripheral device power supply or directly to power supply line 3.

Line voltage sensor 25 here, simply consists of a connection a first side of secondary transformer coil 42 at node 54 which, is also connected to an input of second full-wave bridge rectifier 43. Full-wave bridge rectifier 43 provides a rectified power source for peripheral device 2. The voltage at node 54 is sampled and held by sample and hold circuit 26. Sample and hold circuit 26 is defined by a diode 44 and capacitor 45. As with integrator 19, sample and hold circuit 26 is reset every one-half cycle by FET 46 and microcontroller 22. The output of sample and hold circuit 26 is connected to the input of a second serial output analog to digital converter 47, again a TLC548.

The serial signal produced by second serial output analog to digital converter 47 is fed into a second input on selector 21.

Crossover detector 28 is connected across all three taps of secondary transformer coil 42. Crossover detector 28 here consists of a dual comparator IC LM393, which is shown in FIG. 3 as first comparator 48 and second comparator 49. Comparator 48 compares the alternating voltage at node 54 with center tap 50, while second comparator 49 compares the voltage at node 55 with center tap 50. The outputs of comparators 48 and 49 are summed or ORed together such that an enable signal will be generated at crossover regardless of the polarity and phase of the voltage in secondary transformer coil 42. The enable signal is directed to the enable input 29 of microcontroller 22.

Microcontroller 22 is configured to selectively monitor both the digitized current and voltage levels. By comparing relative values, microcontroller 22 can distinguish between valid current surges, i.e. those due to parent device activity, and power line fluctuations due to brownouts and the like. Microcontroller 22 selects either the digital current level or the digital voltage level via the select signal on line 31 and selector 21. Microcontroller 22 uses the signal at enable 29 to synchronize peripheral device activation or de-activation with a crossover detection.

Solid-state relay 24 is connected to microcontroller 22 at output 23. Solid-state relay 24 here includes optoisolator 51, which isolates the peripheral device 2 from microcontroller 22, and triac 52. Optoisolator 51, which is a MPC30114, will trigger triac 52 responsive to an activation signal from microcontroller 22.

System clock 53 provides timing signals for the microcontroller 22 and comprises a standard 555 timer in an astable multivibrator configuration.

In use, microcontroller 22 is configured to monitor power supply line 3 and determine quiescent values for both the line current and line voltage. Microcontroller 22 then compares subsequent current and voltage levels to detect a valid current surge. A valid current surge occurs when the activity level of parent device is increased without a corresponding voltage increase. Upon such a current surge detection, microcontroller 22 will wait for a crossover detection and activate peripheral device 2 for a preset period of time. Microcontroller 22 will continue to activate and reactivate solid-state relay 24 until the current returns to its quiescent level and the selected time period has expired.

While there is shown and described the present preferred embodiment of the invention, it is to be distinctly understood that this invention is not limited thereto but may be variously embodied to practice within the scope of the following claims.

I claim:

1. An electrical circuit for activating a peripheral device and responsive to an increase in current demanded by a cooperating parent device and representative of an increase in electrical activity of said cooperating parent device, comprising:

means for monitoring the current flow in a power supply line operably connected to said parent device;

means for detecting a current surge operably connected to said monitoring means; and means responsive to said current surge detection for activating said peripheral device immediately after a current surge detection and for a selectable period of time, said activating means being operably connected to said detection means and to said peripheral device.

2. An electrical circuit for activating a peripheral device and responsive to an increase in current demanded by a cooperating parent device and representative of an increase in electrical activity of said cooperating parent device, comprising:

means for monitoring the current flow in a power supply line operably connected to said parent device;

means for detecting a current surge operably connected to said monitoring means;

means responsive to said current surge detection for activating said peripheral device immediately after a current surge detection and for a selectable period of time, said activating means being operably connected to said detection means and to said peripheral device, and means for distinguishing a current surge due to normal parent device activity from random current surges, said distinguishing means being operably connected to said detection means and said activation means.

3. The electrical circuit of claim 2 wherein said current surge detection means and said peripheral device activation means comprise:

a full-wave bridge rectifier operably connected to said inductive monitoring means for generating a rectified electrical signal which is proportional to the current level in the parent device's power supply line;

an integrating circuit operably connected to said full-wave bridge rectifier for generating an average direct current signal which is the average value of the rectified signal;

an analog to digital converter operably connected to said integrating circuit for generating a digital signal which corresponds to the magnitude of the direct current signal;

a microcontroller operably connected to said analog to digital converter and being configured to determine a quiescent value which corresponds to a quiescent current level in the parent device's power supply line while the parent device is in a non-active state and to compare subsequent digital signals to the quiescent value to identify valid current surges and to generate an activation signal of selectable duration for activating the peripheral device; and a triac operably connected and responsive to said microcontroller and further connected between a power supply and the peripheral device for activating the peripheral device responsive to an activation signal.

4. The electrical circuit of claim 3 further comprising an optoisolator operably connected between the triac and the microcontroller for isolating the microcontroller from the triac.

5. The electrical circuit of claim 4 further comprising:

means for monitoring the parent device power supply voltage operably connected thereto;

means for detecting a voltage fluctuation in the parent device power supply voltage operably connected to the monitoring means; and means for correlating a detected voltage fluctuation with a corresponding current surge for identifying random current surges, being operably connected to said voltage fluctuation detection means, said current surge detection means and said peripheral device activation means.

6. The electrical circuit of claim 5 wherein the power supply voltage monitoring means and the voltage fluctuation detection means comprise:

a sample and hold circuit operably connected to the parent device power supply for latching a peak voltage value;

an analog to digital converter operably connected to said sample and hold circuit for producing a digital signal which corresponds to the magnitude of the latched voltage; and a microcontroller operably connected to the analog to digital converter and being configured to monitor voltage fluctuations in the parent device power supply, and to determine a quiescent reference value which corresponds to the quiescent voltage level of the parent device power supply, and to compare the monitored voltage fluctuations to the quiescent reference value.

7. The electrical circuit of claim 3 further comprising:

means for monitoring the parent device power supply voltage operably connected thereto;

means for detecting a voltage fluctuation in the parent device power supply voltage operably connected to the monitoring means; and means for correlating a detected voltage fluctuation with a corresponding current surge for identifying random current surges, being operably connected to said voltage fluctuation detection means, said current surge detection means and said peripheral device activation means.

8. The electrical circuit of claim 7 wherein the power supply voltage monitoring means and the voltage fluctuation detection means comprise:

a sample and hold circuit operably connected to the parent device power supply for latching a peak voltage value;

an analog to digital converter operably connected to said sample and hold circuit for producing a digital signal which corresponds to the magnitude of the latched voltage; and a microcontroller operably connected to the analog to digital converter and being configured to monitor voltage fluctuations in the parent device power supply, and to determine a quiescent reference value which corresponds to the quiescent voltage level of the parent device power supply, and to compare the monitored voltage fluctuations to the quiescent reference value.

9. The electrical circuit of claim 7 further comprising:

means for determining the magnitude of a current surge due to normal parent device activity operably connected to said current detection means; and means for selecting the selectable time period of said peripheral device operation dependent upon the magnitude of the current surge, being operably connected to said magnitude determining means and said peripheral device activation means.

10. An electrical circuit for activating a peripheral device and responsive to an increase in current demanded by a cooperating parent device and representative of an increase in electrical activity of said cooperating parent device, comprising:

means for monitoring the current flow in a power supply line operably connected to said parent device;

means for detecting a current surge operably connected to said monitoring means;

means responsive to said current surge detection for activating said peripheral device immediately after a current surge detection and for a selectable period of time, said activating means being operably connected to said detection means and to said peripheral device, and means for determining the magnitude of a power line current surge due to normal parent device activity operably connected to said current detection means; and means for selecting the selectable time period of said peripheral device operation dependent upon the magnitude of the current surge, said selecting means being operably connected to said magnitude determining means and said peripheral device activation means.

11. An electrical circuit for activating a peripheral device responsive to a cooperating parent device, which comprises:

a current transformer being electromagnetically coupled with the parent device's power supply line for inductively monitoring current level in the power supply line;

a full-wave bridge rectifier operably connected to said current transformer for rectifying the current induced by said current transformer and generating a rectified electrical signal proportional in magnitude to the average current level in the parent device's power supply line;

a load resistor operably connected across the output of said full-wave bridge rectifier for converting the rectified electrical signal to a rectified voltage;

an integrator operably connected across said load resistor for integrating the rectified voltage and generating an averaged voltage signal whose magnitude is proportional to the average current level in the parent device's power supply line;

a first analog to digital converter operably connected to said integrator for generating a first digital signal whose magnitude corresponds to the magnitude of the averaged voltage signal;

a sample and hold circuit operably connected to the peripheral device's power supply line for latching a peak voltage value which corresponds to the voltage level in the peripheral device's power supply line;

a second analog to digital converter operably connected to said sample and hold circuit for generating a second digital signal whose magnitude corresponds to the magnitude of the latched voltage value;

a dual input multiplexer operably connected to both said first and second analog to digital converters for alternately supplying the first and second digital signals to a microcontroller;

a crossover detector operably connected to the peripheral device's power supply line for detecting the voltage crossover points in the peripheral device's power supply line;

a microcontroller operably connected to said dual input multiplexer, said integrator, said crossover detector and said latch and hold circuit and being configured to generate an activation signal of selectable duration at its output by alternately monitoring first and second digital signals, resetting said integrator and said sample and hold circuit to generate subsequent signals, establishing quiescent current and voltage levels, comparing subsequent first and second digitals to the quiescent levels, distinguishing between random power line fluctuations and valid current surges, and synchronizing the activation signal with a crossover detection;

an optoisolator operably connected to the output of said microcontroller; and a solid-state relay operably connected and responsive to said optoisolator and further connected between the peripheral device and the peripheral device's power supply for activating and de-activating the peripheral device responsive to an activation signal from said microcontroller.

12. A method for activating a peripheral device and responsive to an increase in current demanded by a cooperating parent device, comprising the steps of:

monitoring the current flow in a power supply line for said parent device;

detecting a current surge in said power supply line;

responding to said current surge detection and thereby activating said peripheral device for a selectable period of time beginning immediately after said current surge detection, so that said peripheral device remains inoperable and quiet and consumes no power until needed and without requiring operator assistance, and distinguishing a current surge due to normal parent device activity from random current surges.

13. The method of claim 12 wherein said current surge distinguishing step further comprises the steps of:

monitoring the power supply line voltage;

detecting a voltage fluctuation; and correlating a detected voltage fluctuation with a corresponding current surge to identify random current surges.

14. The method of claim 13 further comprising the steps of:

determining the magnitude of a power line current surge due to normal parent device activity; and selecting the selectable time period for operating the peripheral device dependent upon the magnitude of the current surge.

15. A method for activating a peripheral device and responsive to an increase in current demanded by a cooperating parent device, comprising the steps of:

monitoring the current flow in a power supply line for said parent device;

detecting a current surge in said power supply line; and responding to said current surge detection and thereby activating said peripheral device for a selectable period of time beginning immediately after said current surge detection, so that said peripheral device remains inoperable and quiet and consumes no power until needed and without requiring operator assistance.

* * * * *